US007758705B2

(12) United States Patent
Ahn et al.

(10) Patent No.: US 7,758,705 B2
(45) **Date of Patent: *Jul. 20, 2010**

(54) DISHWASHER HAVING A DOOR PASSAGE THROUGH WHICH STEAM FLOWS

(75) Inventors: Byung Hwan Ahn, Kimhae-si (KR); Soung Bong Choi, Changwon-si (KR); Deung Hee Lee, Kimhae-si (KR); Hung Myoung Cho, Kimhae-si (KR); Hyeok Deok Kim, Changwon-si (KR); Seong Hae Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 876 days.

This patent is subject to a terminal disclaimer.

(21) Appl. No.: 11/442,616

(22) Filed: May 30, 2006

(65) Prior Publication Data

US 2007/0102026 A1 May 10, 2007

(30) Foreign Application Priority Data

May 31, 2005 (KR) ..... 10-2005-0046135

(51) Int. Cl.

| | |
|---|---|
| ***B08B 3/02*** | (2006.01) |
| ***B08B 9/02*** | (2006.01) |
| ***F26B 21/02*** | (2006.01) |
| ***F26B 19/00*** | (2006.01) |

(52) U.S. Cl. ..... 134/57 D; 134/57 DL; 134/58 D; 134/58 DL; 134/102.1; 34/76; 34/77; 34/78

(58) Field of Classification Search ..... 134/25.2, 134/18, 56 D, 94.1, 184, 58 D, 102.1, 57 D; 34/68, 72, 73, 74, 76, 77, 218, 219, 231, 34/233

See application file for complete search history.

(56) References Cited

U.S. PATENT DOCUMENTS

| | | | | |
|---|---|---|---|---|
| 3,072,128 | A * | 1/1963 | James | 134/57 D |
| 2004/0163686 | A1 * | 8/2004 | Kang | 134/58 D |
| 2006/0236556 | A1 * | 10/2006 | Ferguson et al. | 34/73 |
| 2009/0095332 | A1 * | 4/2009 | Lee | 134/105 |

* cited by examiner

*Primary Examiner*—Michael Barr
*Assistant Examiner*—Saeed T Chaudhry
(74) *Attorney, Agent, or Firm*—McKenna Long & Aldridge LLP

(57) ABSTRACT

A dishwasher and a controlling method thereof are provided. The dishwasher includes a tub, a door, a steam supplying unit, a fan, and a passage. The tub stores dishes. The door opens and closes the tub. The steam supplying unit supplies steam into the tub. The fan blows the steam. The passage forming unit is formed to circulate the steam blown by the fan inside the tub, or to discharge the steam to the outside of the tub.

14 Claims, 7 Drawing Sheets

【Figure 1】
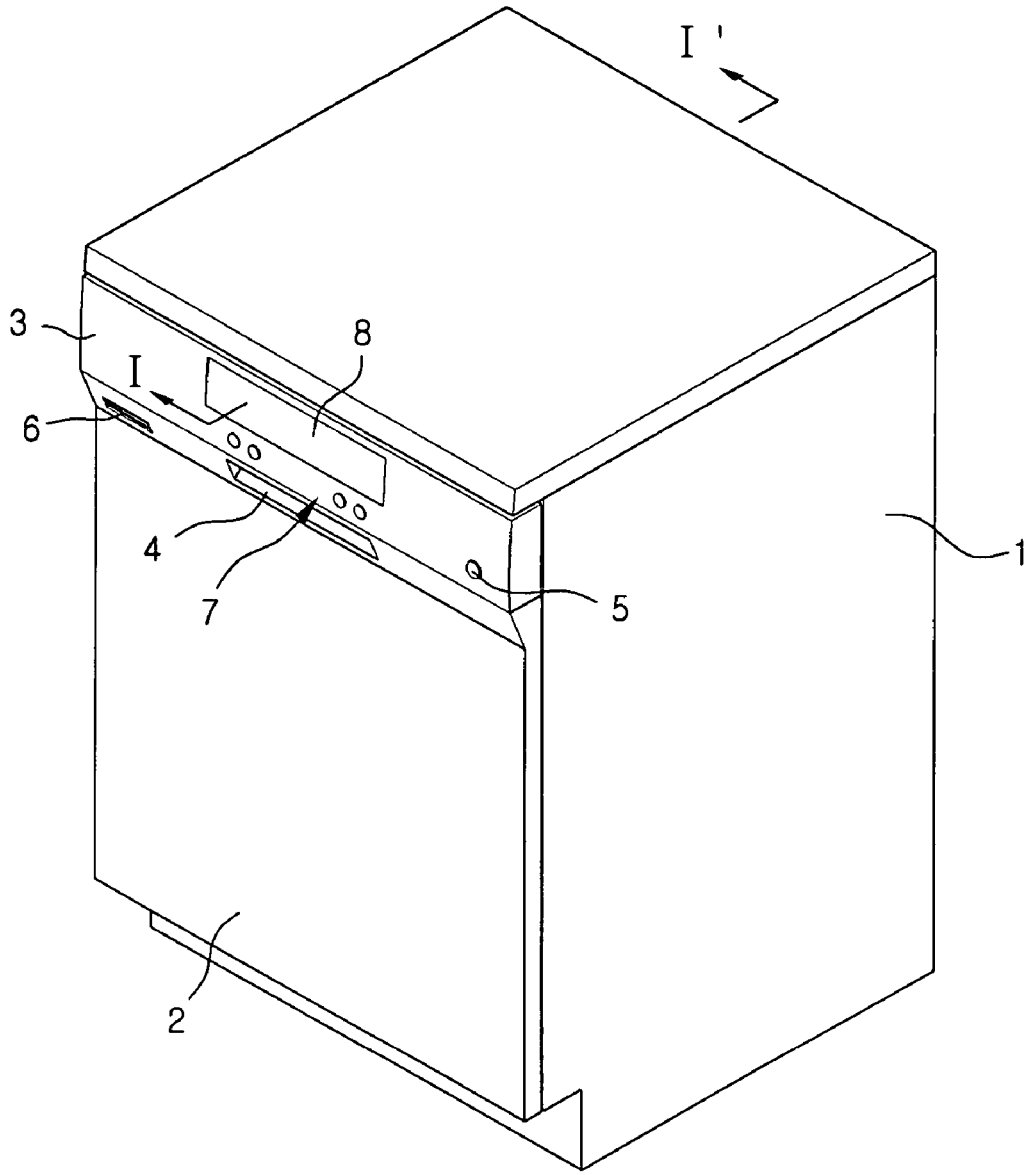

【Figure 2】
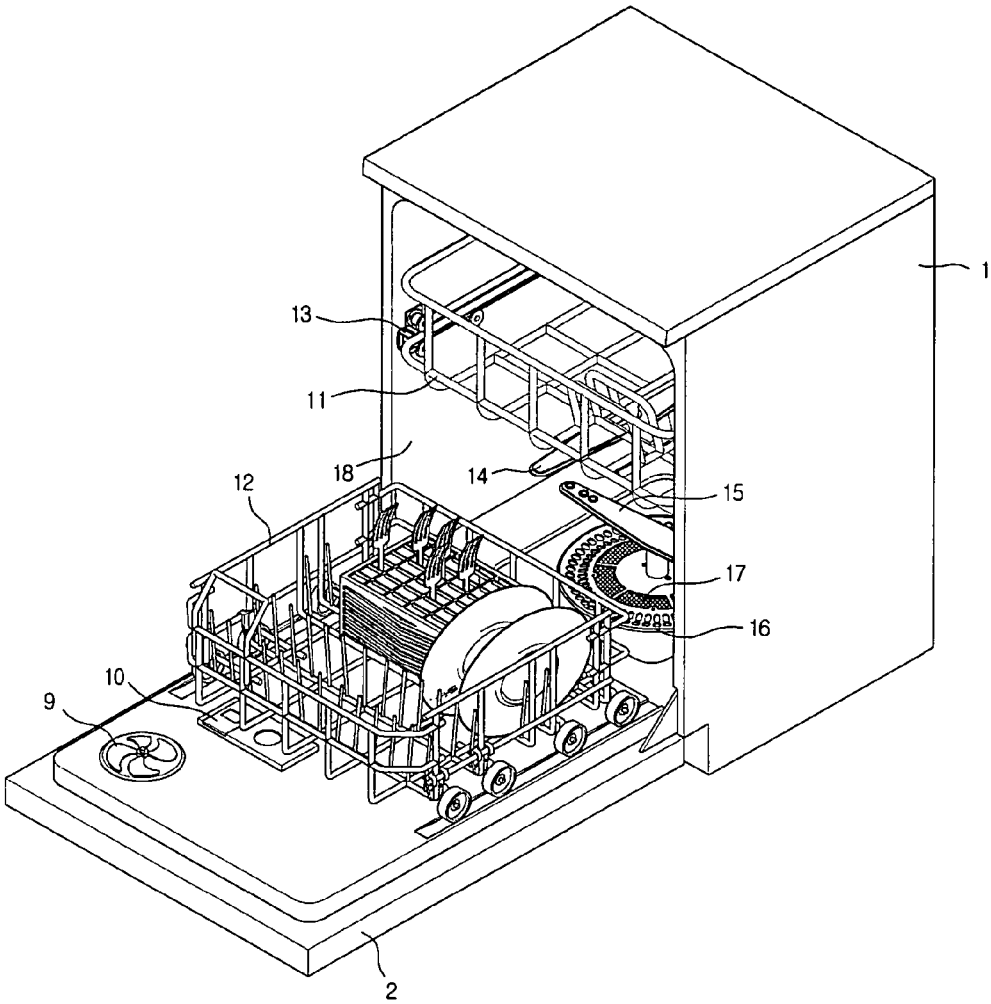

【Figure 3】
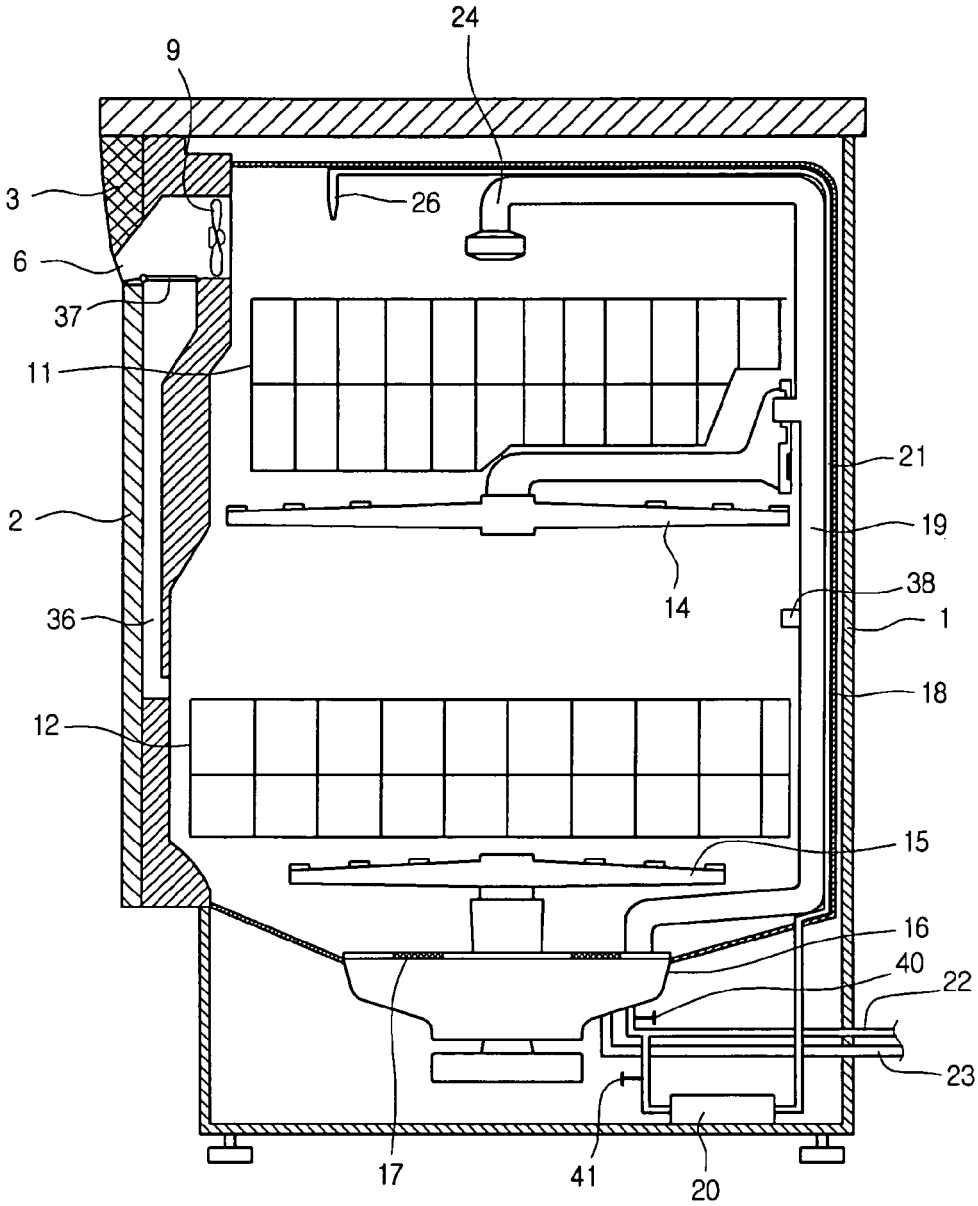

【 Figure 4】
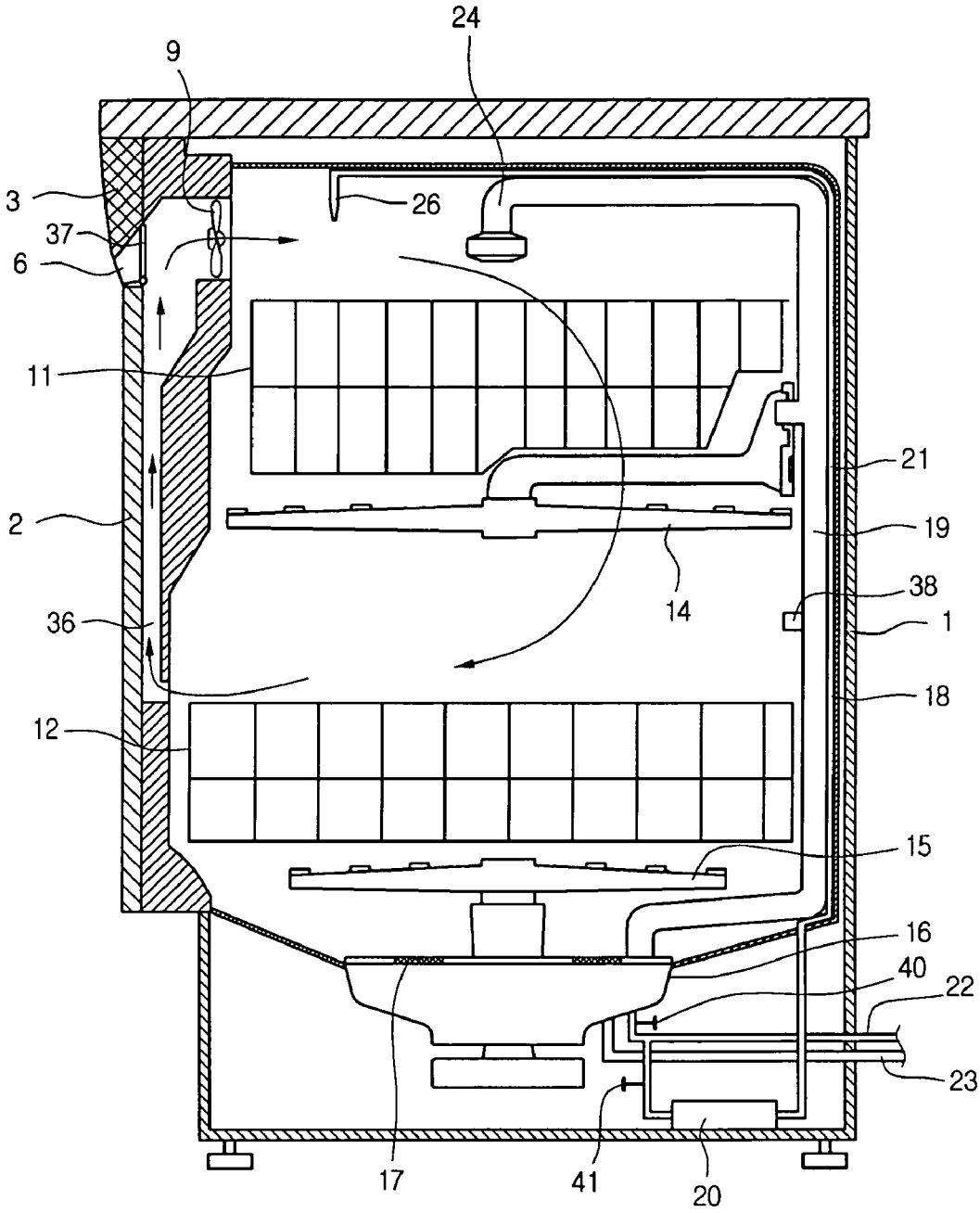

【 Figure 5】
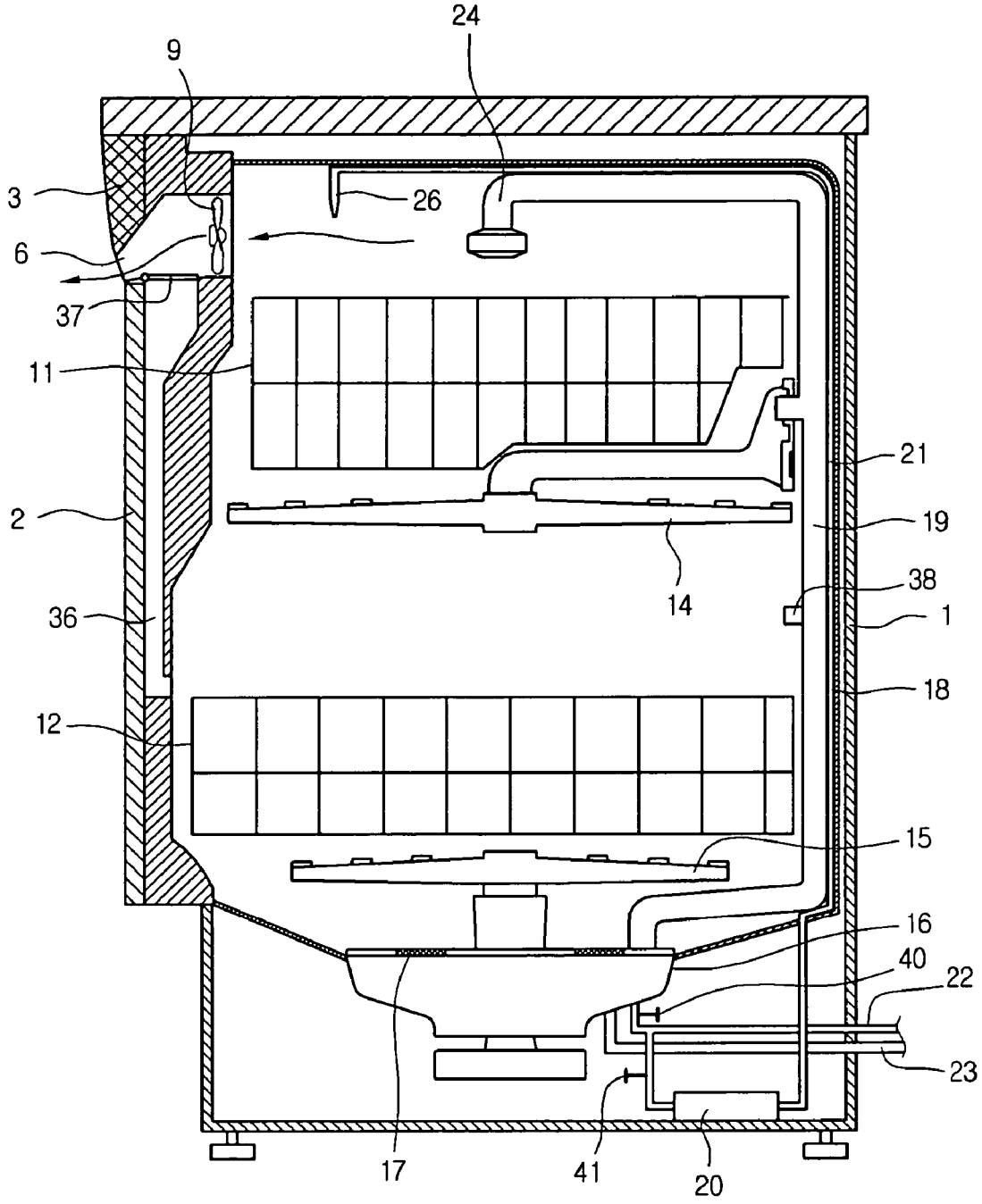

【 Figure 6】
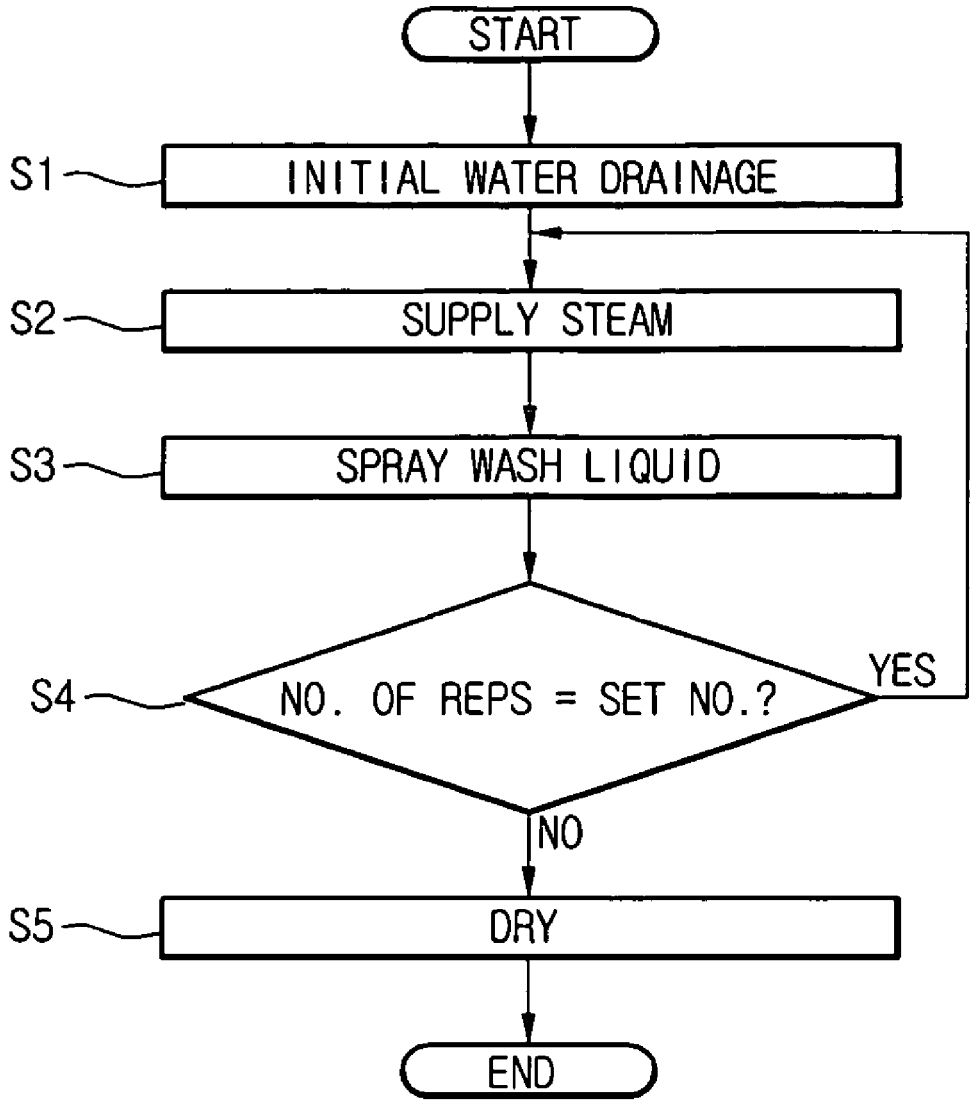

【Figure 7】
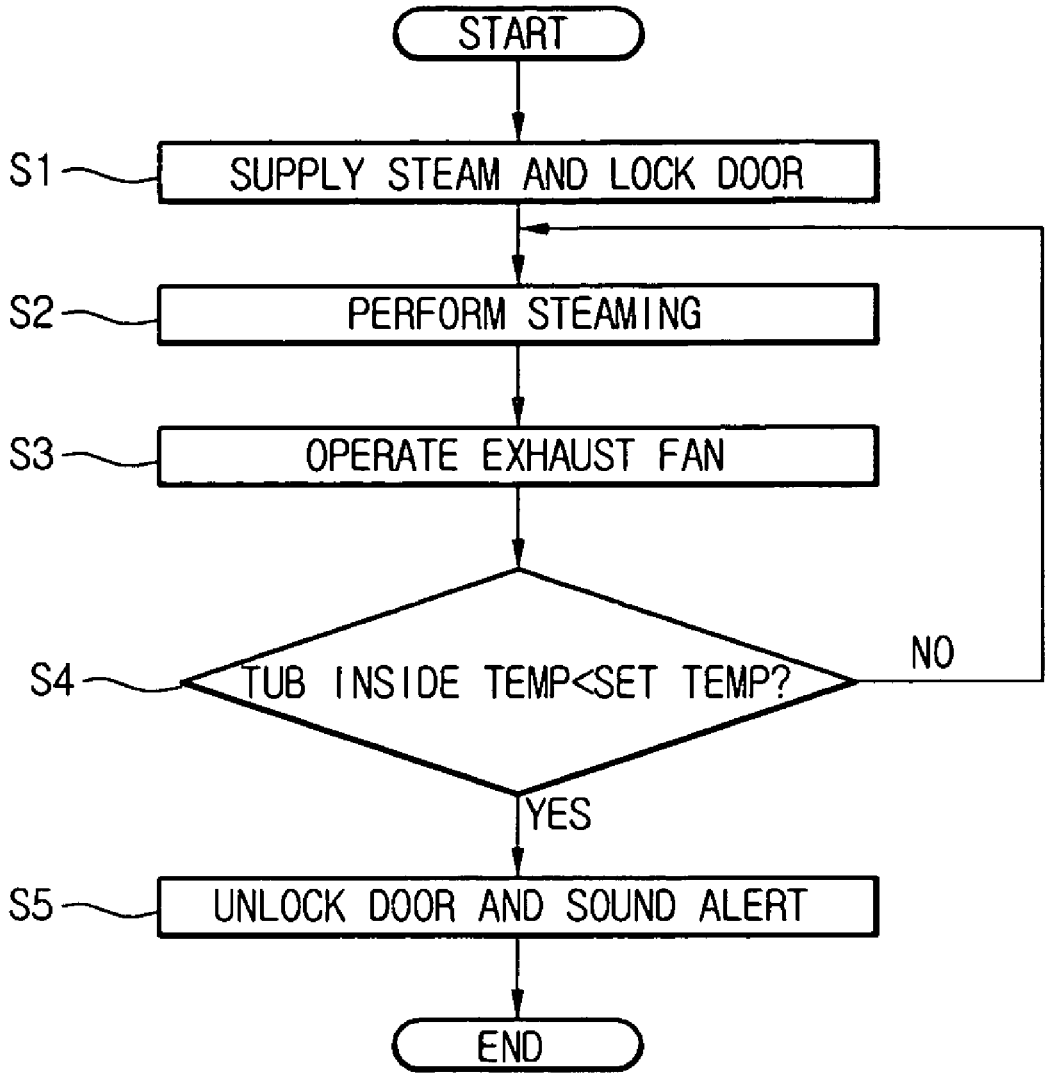

DISHWASHER HAVING A DOOR PASSAGE THROUGH WHICH STEAM FLOWS

This application claims the benefit of Korean Patent Application No. 10-2005-0046135, filed on May 31, 2005, which is hereby incorporated by reference for all purposes as if fully set forth herein.

BACKGROUND OF THE INVENTION

1. Field of the Invention

The present invention relates to a dishwasher and a controlling method thereof.

2. Description of the Related Art

A dishwasher is a home appliance that sprays high-pressure wash liquid within a tub to wash and remove food residue and other impurities left on surfaces of dishes. A filter filters the food residue from the wash liquid to recycle the latter, and detergent is dissolved into the wash liquid to facilitate the removal of food residue.

In order to improve the above dishwashing process, the following dishwasher functions have been developed.

First, by heating wash liquid to aid in dissolving the detergent, overall dishwashing effectiveness can be improved. Also, by heating wash liquid, the wash liquid can more easily remove glutinous rice and other hardened food residue.

Furthermore, by dividing the wash cycle of a dishwasher into a pre-wash cycle and a main wash cycle, the pre-wash cycle soaks hardened food residue, so that it can be more easily removed in the main wash cycle. Another method being employed is removing germs and sterilizing dishes by emitting ultraviolet light onto the surfaces of dishes.

However, despite the above devised methods according to the related art, the problem of increasing dishwashing efficiency remains. Especially in oriental households, where in many cases, the staple food is glutinous rice, the latter is difficult to effectively remove from dishes, exasperating the problem of dishwashing efficiency. Even the use of hot water to soak food residue cannot completely obviate the above problem. Also, because soaking requires a prolonged amount of time, it lengthens the duration of the wash cycle.

The above problems reduce the overall washing efficiency of a dishwasher.

SUMMARY OF THE INVENTION

Accordingly, the present invention is directed to a dishwasher and controlling method thereof that substantially obviate one or more problems due to limitations and disadvantages of the related art.

An object of the present invention is to provide a dishwasher and a controlling method thereof that allow food residue hardened on dishes in the dishwasher to be easily removed, thereby increasing dishwashing effectiveness.

Another object of the present invention is to provide a dishwasher and a controlling method thereof that quickly perform a soaking function, so that the duration of a wash cycle is reduced to be more convenient for a user.

A further object of the present invention is to provide a dishwasher with a region in a tub that receives highly concentrated steam in order to increase sterilization efficiency, and a method of controlling the dishwasher.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided dishwasher including: a tub for storing dishes; a door for opening and closing the tub; a steam supplying unit for supplying steam into the tub; a fan for blowing the steam; and a passage forming unit formed for circulating the steam blown by the fan inside the tub, or for discharging the steam to an outside of the tub.

In another aspect of the present invention, there is provided a dishwasher including: a tub for storing dishes; a door for opening and closing the tub; a steam supplying unit for supplying steam to an inside of the tub; and a fan for blowing the steam.

In a further aspect of the present invention, there is provided a dishwasher including: a tub for storing dishes; a door for opening and closing the tub; a steam supplying unit for supplying steam to an inside of the tub; a fan for blowing the steam; and a door passage including a discharging passage formed in the door for communicating the inside and an outside of the tub, an entrance hole for allowing the steam to pass through the door and circulate in the tub, and a circulating passage forming a discharging hole toward the tub.

In an additional aspect of the present invention, there is provided a controlling method of a dishwasher, including: supplying steam inside a tub; locking a door; sensing a temperature inside the tub; and unlocking the locked door according to the sensed temperature.

Because the dishwasher according to the present invention can satisfactorily clean dishes physically, chemically, and biologically at the same time, it is more efficient to use this dishwasher.

Also, because the dishwasher uses an exhaust fan and a door passage, its operating functions are diversified.

Furthermore, when steam is supplied, the steam can be more quickly distributed throughout the tub interior, increasing the dishwasher's efficiency of supplying steam.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a dishwasher according to the present invention;

FIG. 2 is a perspective view of a dishwasher according to the present invention with its door open;

FIG. 3 is a sectional view taken along line I-I' of FIG. 1;

FIGS. 4 and 5 are sectional views of a dishwasher according to the present invention showing the relation between the damper and the exhaust fan;

FIG. 6 is a flowchart of a controlling method of a dishwasher according to the present invention; and FIG. 7 is a flowchart of a controlling method of a dishwasher, according to another embodiment of the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a perspective view of a dishwasher according to the present invention.

Referring to FIG. 1, a dishwasher according to the present invention includes a case 1 forming an outer shape of the dishwasher and an opening at a front thereof, a door 2 sealing the opening at the front of the case 1, and a control panel 3 provided above the door 2, for displaying and controlling the operation of the dishwasher.

In detail, the control panel 3 includes a power switch 5 for switching power to the dishwasher on and off, a door handle 4 used to open and close the door 2, controls 7 for implementing a predetermined operation of the dishwasher according to a user's inputted commands, a display 8 for displaying the operation of the dishwasher, and a steam discharge hole 6 for exhausting hot air from inside the dishwasher.

FIG. 2 is a perspective view of a dishwasher according to the present invention with its door open.

Referring to FIG. 2, a tub 18 for containing wash liquid inside the dishwasher is disposed therein, and a sump 16 disposed at the bottom of the tub 18 for collecting, filtering, and re-circulating wash liquid to be sprayed.

In detail, the inside of the tub 18 includes an upper dish rack 11 and a lower dish rack 12 for placing dishes in, and an upper spray arm 14 and top spray nozzle 24 for spraying wash liquid respectively towards the upper dish rack 11, and a lower spray arm 15 for spraying wash liquid towards the lower dish rack 12. The inner surfaces of the tub 18 have a rail 13 extending from front to rear in order to slide the upper dish rack 11 thereon. A filter 17 is disposed at the bottom of the tub 18 to filter impurities from wash liquid.

A wash liquid passage 19 is provided at an inner side surface of the tub 18, for supplying wash liquid to the upper spray arm 14 and the top spray nozzle 24.

The door 2 is coupled to the case 1 through a hinge (not shown) at the bottom of the door 2, so that a user can pivot the door about the hinge in an upward or downward direction. An exhaust fan 9 formed in a predetermined location on the door 2 can forcefully expel air from inside the tub 18 to the outside. Also, a detergent cup 10 for holding a predetermined amount of detergent supplied therein is formed in the inner surface of the door 2, and supplies that amount of detergent during the operation of the dishwasher.

FIG. 3 is a sectional view of the dishwasher in FIG. 1 taken along line I-I'.

Referring to FIG. 3, a dishwasher according to the present invention further includes a water supply pipe 22 connecting the tub 18 and a water supply outside of the dishwasher to supply water into the tub 18, a water draining pipe 23 for draining wash liquid (that has been used for dishwashing and is contaminated), a steam generator 20 for generating steam and disposed below the tub 18, and a steam supply pipe 21 for supplying the steam generated by the steam generator 20 to the inside of the tub 18.

In detail, the steam supply pipe 21 forms a steam discharger 26 for discharging steam from one end thereof. Because the steam discharger 26 is located at the top of the tub 18, even when wash liquid is sprayed into the tub 18, the wash liquid does not enter the steam supply pipe 21. The steam supply pipe 21 extends vertically and in parallel with the wash liquid passage 19 along the rear inner surface of the tub 18.

The water supply pipe 22 branches in two. In order to regulate the flow of water passing through the branched water supply pipe 22, a tub water regulating valve 40 and a steam water regulating valve 41, for opening and closing the water supply pipe 22, are formed on the respective branches. The tub water regulating valve 40 controls the flow of water flowing to the tub, and the steam water regulating valve 41 controls the flow of water flowing to the steam generator 20.

A door passage 36 is formed within the door 2, and communicates with a steam discharge hole 6. The steam discharge hole 6 communicates with the inside of the tub 18 through the exhaust fan 9. A damper 37 is provided at the portion connecting the steam discharging hole 6 to the door passage 36. The damper 37 is positioned variably, such that the operation of the exhaust fan 9 changes according to the position of the damper 37.

FIGS. 4 and 5 are sectional views of a dishwasher according to the present invention showing the relation between the damper and the exhaust fan.

Referring to FIG. 4, the damper 37 has moved to a position blocking the steam discharge hole 6. When the damper 37 is blocking the steam discharging hole 6, the exhaust fan 9 rotates in a reverse direction to suction air into the door passage 36 and discharge it back into the tub 18.

Here, the reverse rotating direction of the exhaust fan 9 circulates air in a clockwise direction, as shown by the arrows in FIG. 4. Conversely, should the exhaust fan 9 rotate in a forward direction, the movement of air would be in a counter-clockwise direction in FIG. 4.

Referring to FIG. 5, the damper 37 has moved to a position blocking the door passage 36. When the damper 37 is blocking the door passage 36, the exhaust fan 9 rotates in a forward direction to suction hot air from inside the tub 18 and discharge through the steam discharging hole 6.

In detail, FIG. 4 shows steam that is being discharged from the steam discharger 26 being dispersed throughout the inside of the tub 18. When the exhaust fan 9 rotates in reverse to supply air into the tub 18, the supplied air carries the steam discharged from the steam discharger 26 and circulates. Thus, a sterilizing space can be said to be the space in the tub 18 to the rear of the steam discharger 26 along a line extending rearward from the exhaust fan 9 and the steam discharger 26. Air is forcibly circulated through the door passage 36; and because the inside of the door is cooler than the remaining interior of the tub 18, the air inside the tub can be slowly cooled.

As described above, the operation in FIG. 4 increases the functional capabilities of the dishwasher.

Referring to FIG. 5, a discharging function is shown, for discharging the air inside the tub through the steam discharging hole 6 to the outside when steam filling the inside of the tub 18 heats the tub 18.

The steam is exhausted slowly to prevent burns that may result from a user suddenly opening the door when the tub 18 is filled with steam supplied into the tub 18 from the steam generator 20, where the steam is usually over 100° C. Furthermore, by forcibly exhausting steam from the tub through the steam discharge hole 6, the temperature inside the tub can be lowered quickly to rapidly allow a user who is short of time to quickly remove dishes from the tub 18.

At a certain point during the above operation of the dishwasher, the steam generated by the steam generator 20 passes through the steam supply pipe 21 to be supplied into the tub 18. Thus, the hot and moist characteristics of the steam ameliorate the operational reliability and efficiency of the dishwasher.

Below, a controlling method of a dishwasher will be described with reference to the diagrams.

FIG. 6 is a flowchart of a controlling method of a dishwasher according to the present invention.

Referring to FIG. 6, before dishes are placed inside the dishwasher and the dishwasher is operated, water present in the dishwasher is first drained in an initial draining in step S1. After the initial draining is completed, steam is supplied into the tub 18 in step S2. The supplying of steam in step S2 involves the steam generator 20 generating steam, which then travels through the steam supply pipe 21 into the tub 18. The time that the steam supplying step S2 takes and the amount of steam supplied in step S2 may be variably set according to the amount and the state of cleanliness of dishes placed inside the tub 18. For example, if glutinous rice is hardened on dishes, the steam supplying stage may be set for a longer duration.

By implementing the steam supplying step S2 once, hardened food residue is softened, after which wash liquid is sprayed toward the dishes in step S3. Here, even if wash liquid is sprayed at a lower pressure, food residue can easily be removed because it has already been soaked in steam.

After the one-time supplying of steam in step S2 and the spraying of wash liquid in step S3, a determining in step S4, of whether to repeat the spraying of wash liquid in step S3 and the supplying of steam in step S2, is performed according to the set wash course and/or a user's inputs. If it is determined in step S4 that the actual number of times wash liquid has been sprayed and steam has been supplied in steps S3 and S2 does not equal a preset number for steps S3 and S2, steps S3 and S2 are repeated.

Thus, because the duration over which food residue is soaked increases with an increase in the number of times wash liquid is discharged and steam is supplied according to a pre-wash cycle, the amount of food residue left on dishes decreases over time. Furthermore, because food residue hardened on dishes is softened during the supplying of steam in step S2, the food residue can be completely removed.

Likewise, by alternating and repeating the spraying of wash liquid in step S3 and the supplying of steam in step S2, food residue can more reliably be removed from dishes, thereby increasing the efficiency of the dishwasher.

The alternating implementation of the spraying of wash liquid and the supplying of steam in steps S3 and S2 may be performed at least once with detergent supplied, so that grease can be entirely removed from the dishes.

At least one final rinse cycle without introducing detergent may be performed during the spraying of wash liquid and the supplying of steam in steps S3 and S2, in order to prevent detergent remaining on the dishes.

When the set number of steps matches the number of actually performed steps, the spraying of wash liquid is ceased and cool or hot air is blown in a drying cycle in step S5.

The steam supplied through the controlling method according to the present invention may be adjusted according to the quantity and type of dishes or other items stored in the dishwasher, and through a user's direct input. For example, when a large quantity of dishes must be washed, a suitably large quantity of steam may be supplied.

As described, because the controlling method of a dishwasher according to the present invention may alternately repeat the supplying of steam to soften hardened food deposits and then the spraying of wash liquid (in other words, the alternate repeating of supplying steam and spraying wash liquid), the efficiency of washing dishes increases. This improved washing efficiency results from the softening of hardened food deposits due to the supplying of steam so that the food residue can be easily washed off, and the fact that the steam is hot (which kills germs on the dishes for a sterilizing effect).

FIG. 7 is a flowchart of a controlling method of a dishwasher, according to another embodiment of the present invention.

Referring to FIG. 7, in order to implement sterilizing and/or soaking of hardened food deposits, when the supply of steam into the tub 18 begins, the door is locked in step S1, to protect a user. After the door is locked, sterilizing and soaking is performed by continually supplied steam in step S2.

Next, when the supplying of steam is stopped after a required amount of steam is supplied, the exhaust fan 9 is rotated. The damper 37 blocks the door passage 36, so that the steam inside the tub 18 is forcibly expelled in step S3 (refer to FIG. 5). The operation of the exhaust fan 9 is performed according to a measurement from the temperature sensor 38 (in FIG. 3), and the exhaust fan 9 continues operating until the temperature inside the tub 18 is measured as being lower than a preset temperature, in step S4.

When the temperature inside the tub 18 falls below the preset temperature, the locked door unlocks and an alerting sound signaling that the door can be opened is emitted.

In order to disperse the steam throughout the inside of the tub 18, the exhaust fan 9 is rotated in reverse, and the damper 37 opens the door passage 36. Accordingly, the steam within the tub can be rapidly dispersed throughout.

The supplying of steam according to the present invention allows sterilizing and soaking of dishes, and the concentrated supplying of steam in a region of the tub provides a predetermined sterilizing space.

Another advantage of the present invention is its quick removal of steam from the tub, and the provision of a door locking function that prevents a user from opening the door when the inside of the dishwasher is hot, so that the user can be protected.

Because the dishwasher according to the present invention can satisfactorily clean dishes physically, chemically, and biologically at the same time, it is more efficient to use this dishwasher.

Also, because the dishwasher uses an exhaust fan and a door passage, its operating functions are diversified.

Furthermore, when steam is supplied, the steam can be more quickly distributed throughout the tub interior, increasing the dishwasher's efficiency of supplying steam.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a tub for storing dishes;

a door for selectively closing the tub and having a door passage for circulation formed interior thereof, wherein the door passage is provided with at least one hole for circulation through which steam flows;

a steam discharge hole formed at one side of the door to discharge steam from an inside to an outside of the tub;

a damper configured to close the hole for circulation or the steam discharge hole, wherein the damper closes the hole for circulation when the damper is at one position, and the damper closes the steam discharge hole when the damper is at another position; and a steam supplying unit for supplying steam into the tub.

2. The dishwasher according to claim 1, further comprising a fan disposed on the door passage to blow the steam.

3. The dishwasher according to claim 2, wherein a steam circulating passage for the steam blown by the fan is formed through the door, the steam circulating passage including an inflow and a discharging hole.

4. The dishwasher according to claim 2, wherein a steam discharging passage for the steam blown by the fan is formed through the door of the dishwasher, the steam discharging passage for communicating the inside and the outside of the tub.

5. The dishwasher according to claim 1, wherein the tub includes a temperature sensor installed therein, the temperature sensor for sensing a temperature of the tub and controlling a locked state of the door.

6. A dishwasher comprising:

a tub for storing dishes;

a door for opening and closing the tub;

a door passage for circulation formed inside of the door and through which steam flows;

a steam discharge hole configured to discharge steam from an inside to an outside of the tub;

a damper installed on one side of the steam discharge hole; and a fan for blowing the steam, wherein the door passage for circulation is open when the damper closes the steam discharge hole, and the steam discharge hole is open when the damper closes the door passage for circulation.

7. The dishwasher according to claim 6, wherein the fan forcibly circulates air within the tub.

8. The dishwasher according to claim 6, wherein the fan circulates steam within the tub.

9. The dishwasher according to claim 8, wherein the door passage includes a steam circulating passage for the steam blown by the fan and having an inflow and a discharging hole.

10. The dishwasher according to claim 8, wherein the door passage includes a steam discharging passage for the steam blown by the fan and the discharging passage is for communicating the inside and the outside of the tub.

11. The dishwasher according to claim 6, wherein the fan blows the steam supplied inside the tub to an outside of the tub.

12. A dishwasher comprising:

a tub for storing dishes;

a door for opening and closing the tub;

a steam supplying unit for supplying steam to an inside of the tub;

a fan for blowing the steam;

a door passage including a discharging passage formed in the door for communicating the inside and an outside of the tub, and a circulating passage formed with an entrance hole and a discharging hole for allowing the steam to pass through the door and circulate in the tub; and a damper configured to selectively close the discharging passage or the circulating passage.

13. The dishwasher according to claim 12, wherein the damper is disposed on the door passage.

14. The dishwasher according to claim 12, wherein the door is locked when steam enters the inside of the tub, and the locked door is unlocked when a temperature inside the tub falls below a predetermined temperature.

* * * * *